US007431634B2

(12) United States Patent
Lee

(10) Patent No.: US 7,431,634 B2
(45) Date of Patent: Oct. 7, 2008

(54) PLATEN ASSEMBLY, APPARATUS HAVING THE PLATEN ASSEMBLY AND METHOD OF POLISHING A WAFER USING THE PLATEN ASSEMBLY

(75) Inventor: Young-Chul Lee, Hwaseong-si (KR)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 11/702,854

(22) Filed: Feb. 6, 2007

(65) Prior Publication Data

US 2007/0184759 A1 Aug. 9, 2007

(30) Foreign Application Priority Data

Feb. 6, 2006 (KR) ..... 10-2006-0011206

(51) Int. Cl.
*B24B 49/16* (2006.01)

(52) U.S. Cl. ..... 451/11; 451/307; 451/303

(58) Field of Classification Search ..... 451/5, 451/11, 307, 303, 24
See application file for complete search history.

(56) References Cited

U.S. PATENT DOCUMENTS 3,911,627 A * 10/1975 Heesemann ..... 451/299
5,558,568 A * 9/1996 Talieh et al. ..... 451/303
5,916,012 A * 6/1999 Pant et al. ..... 451/41
5,980,368 A * 11/1999 Chang et al. ..... 451/303
6,135,858 A * 10/2000 Takahashi ..... 451/41
6,244,945 B1 * 6/2001 Weldon et al. ..... 451/303
6,358,118 B1 * 3/2002 Boehm et al. ..... 451/24
6,607,425 B1 8/2003 Kistler et al.
2005/0113010 A1 5/2005 Kim

FOREIGN PATENT DOCUMENTS

JP 2005-11977 1/2005
KR 10-2005-0050872 6/2005

* cited by examiner

*Primary Examiner*—Robert Rose
(74) *Attorney, Agent, or Firm*—Mills & Onello LLP

(57) ABSTRACT

In a platen assembly for a polishing apparatus, a platen supports a polishing belt that makes contact with an object during a polishing process, so that the platen provides a pressure on the polishing belt during the polishing process. A plurality of first bladders extends in a first direction on an entire surface of the platen and is spaced apart by a uniform distance, and the first bladders apply pressure to the polishing belt. A plurality of second bladders extends in the first direction on a middle portion of the surface of the platen between a central portion and a peripheral portion of the platen and is positioned between the first bladders, and the second bladders apply pressure to the polishing belt. The pressures of the bladders are individually controlled by pressure controllers. Various pressures are individually applied different portions of the polishing belt by the bladders.

17 Claims, 5 Drawing Sheets

PLATEN ASSEMBLY, APPARATUS HAVING THE PLATEN ASSEMBLY AND METHOD OF POLISHING A WAFER USING THE PLATEN ASSEMBLY

CROSS-REFERENCE TO RELATED APPLICATIONS

This application claims priority under 35 U.S.C. §119 to Korean Patent Application No. 10-2006-0011206 filed on Feb. 6, 2006, the content of which is herein incorporated by reference in its entirety.

BACKGROUND OF THE INVENTION

1. Field of the Invention

Example embodiments of the present invention relate to a platen assembly, an apparatus having the platen assembly and a method of polishing a wafer using the same. More particularly, example embodiments of the present invention relate to a platen assembly for inducing a polishing pad to uniformly polish a wafer, an apparatus having the platen assembly and a method of uniformly polishing a wafer using the platen assembly.

2. Description of the Related Art

In general, a circuit pattern for a semiconductor device is formed through various unit fabrication processes such as a deposition process, a photolithography process, an etching process, an ion implantation process, a polishing process, a cleaning process and a drying process that are performed sequentially and repeatedly. Among the above unit processes for semiconductor device fabrication, the polishing process plays an important role in increasing the degree of integration and in improving structural and electrical reliability of a semiconductor device. The chemical mechanical polishing (CMP) process has become widely employed as a polishing process for manufacturing a semiconductor device. In the CMP process, a thin layer on a wafer is planarized by a chemical reaction between a slurry and the thin layer and by a mechanical friction between a polishing pad and the thin layer.

A conventional apparatus for performing the CMP process (hereinafter, referred to as "CMP apparatus") includes a polishing pad, a platen for supporting the polishing pad, a polishing head to which a wafer is secured, a slurry reservoir from which the slurry is supplied to the polishing pad, and a pad conditioner for improving the quality of the polishing pad. The wafer is rotated on a central axis of the polishing head, and the polishing pad makes contact with the rotating wafer, so that a thin layer present on the wafer is polished by the chemical reaction and mechanical friction between the thin layer on the wafer and the polishing pad.

An example of the conventional CMP apparatus is disclosed in U.S. Pat. No. 6,607,425. This apparatus includes ring-shaped bladders and a pressure membrane on a platen, and each of the bladders is pressurized individually.

FIG. 1 is a view that schematically illustrates a structure of a conventional CMP apparatus. Referring to FIG. 1, the conventional CMP apparatus 1 includes a polishing belt 10 that is circulated by a roller (not shown) so as to polishing a wafer W and a polishing head 20 to which the wafer W is secured and by which the wafer W makes contact with the polishing belt 10. In addition, the conventional CMP apparatus also includes a platen 30 for supporting the polishing belt 10, a plurality of ring-shaped bladders 40 positioned on the platen 30 and a pressure membrane 50 for pressurizing the polishing belt 10 through the bladders 40.

In the conventional CMP apparatus, when a CMP process is performed on the wafer, a peripheral portion of the wafer can be polished to a much larger degree than a central portion thereof due to the pressure distribution of the polishing head 20. That is, a the amount of material removed at the peripheral portion of the water W during the CMP process is much larger than that the amount of material removed at the central portion of the wafer W. To compensate for this difference, the width of the bladder 40 can be made to be larger at the peripheral portion of the platen 30 than at the central portion of the platen 30, thereby minimizing the difference in the amount of material polished between the peripheral portion and the central portion of the wafer W.

The bladders 40 are positioned adjacent to each other in the above conventional CMP apparatus, so that a pressure variation in a first bladder 40 can affect the pressure of second bladders 40 adjacent to the first bladder 40. Hence, the conventional CMP apparatus is limited in that it is difficult uniformly polish the wafer despite the efforts described above to compensate for the difference in the amount of material polished between the central portion and peripheral portion thereof.

SUMMARY OF THE INVENTION

Example embodiments of the present invention provide a platen assembly for uniformly pressurizing a polishing belt.

Example embodiments of the present invention further provide an apparatus for polishing a wafer that includes the above platen assembly.

Example embodiments of the present invention further provide a method of uniformly polishing a wafer using the above apparatus for polishing a wafer.

According to one aspect of the present invention, there is provided a platen assembly for a polishing apparatus comprising a platen and a plurality of first and second bladders. The platen supports a polishing belt that makes contact with an object during a polishing process, so that the platen provides a pressure on the polishing belt during the polishing process. A plurality of the first bladders extend in a first direction on an entire surface of the platen and are spaced apart by a uniform distance. A plurality of the second bladders extend in the first direction on a middle portion of the surface of the platen and are positioned between the first bladders. The first and second bladders apply pressure to the polishing belt.

In one embodiment, the first bladders include central bladders positioned on the central portion of the platen, middle bladders positioned on the middle portions of the platen, and peripheral bladders positioned on the peripheral portion of the platen.

In another embodiment, the first bladders are spaced apart from one another on the central and peripheral portions of the platen by a first distance and apply a first pressure to the polishing belt, whereas the second bladders are spaced apart from one another on the middle portion of the platen by a second distance less than the first distance and apply a second pressure greater than the first pressure to the polishing belt.

In another embodiment, the platen assembly further comprises a first pressure controller for controlling first pressures of the first bladders, and a second pressure controller for controlling second pressures of the second bladders. Further, the platen assembly further comprises an operation unit for rotating the platen.

According to another aspect of the present invention, there is provided an apparatus for polishing an object comprising a polishing belt, a roller, a polishing head and a platen assembly. The polishing belt makes contact with the object, and the roller circulates the polishing belt. The object is secured to the polishing head in such a structure that a surface of the object to be polished faces an upper surface of the polishing belt, so that the polishing head brings the surface of the object to be polished into contact with the upper surface of the polishing belt when the polishing belt is circulated. The platen assembly includes a platen supporting the polishing belt to provide a pressure on the polishing belt when the polishing belt is circulated, a plurality of first bladders extending in a first direction on an entire surface of the platen and spaced apart by a uniform distance, and a plurality of second bladders extending in the first direction on a middle portion of the surface of the platen between a central portion and a peripheral portion of the platen and positioned between the first bladders. The first and second bladders apply pressure to the polishing belt.

In one embodiment, a center of the surface of the object to be polished is positioned on the upper surface of the polishing belt corresponding to the middle portion of the platen when the polishing belt is circulated.

In another embodiment, the first bladders include central bladders positioned on the central portion of the platen, middle bladders positioned on the middle portions of the platen, and peripheral bladders positioned on the peripheral portion of the platen.

In another embodiment, the first bladders are spaced apart from one another on the central and peripheral portions of the platen by a first distance and apply a first pressure to the polishing belt, and the second bladders are spaced apart from one another on the middle portion of the platen by a second distance less than the first distance and apply a second pressure greater than the first pressure to the polishing belt.

In another embodiment, the platen assembly further includes a first pressure controller for controlling first pressures of the first bladders, and a second pressure controller for controlling second pressures of the second bladders. The platen assembly further includes an operation unit for rotating the platen.

According to still another aspect of the present invention, there is provided a method of polishing an object. A first pressure is applied to a lower surface of a circulating polishing belt by a plurality of first bladders that extend in a first direction on a central portion and a peripheral portion of an upper surface of a platen and are spaced apart from one another by a first distance. Then, a second pressure is applied to a lower surface of a circulating polishing belt by a plurality of second bladders that extend in a first direction on a middle portion of the upper surface of the platen between the central portion and the peripheral portion of the upper surface of the platen and are spaced apart from one another by a second distance less than the first distance. A surface of the object to be polished is brought into contact with an upper surface of the polishing belt.

In an example embodiment, a center of the surface of the object to be polished makes contact with a portion of the upper surface of the polishing belt corresponding to the middle portion of the platen when the polishing belt is circulated.

In an example embodiment, the pressures of the first and second bladders are controlled in accordance with a degree of polishing of the object.

According to the present invention, the bladders pressurize different regions of the polishing belt at respectively different pressures, each of which is precisely controlled. Accordingly, the pressure applied to the polishing belt is accurately controlled by adjusting the pressure of the bladders, so that a substantially uniform polishing process can be achieved on a wafer to be polished.

BRIEF DESCRIPTION OF THE DRAWINGS

The above and other features and advantages of the present invention will become more apparent by describing in example embodiments thereof with reference to the accompanying drawings, in which.

DETAILED DESCRIPTION OF EMBODIMENTS

Figure 1:
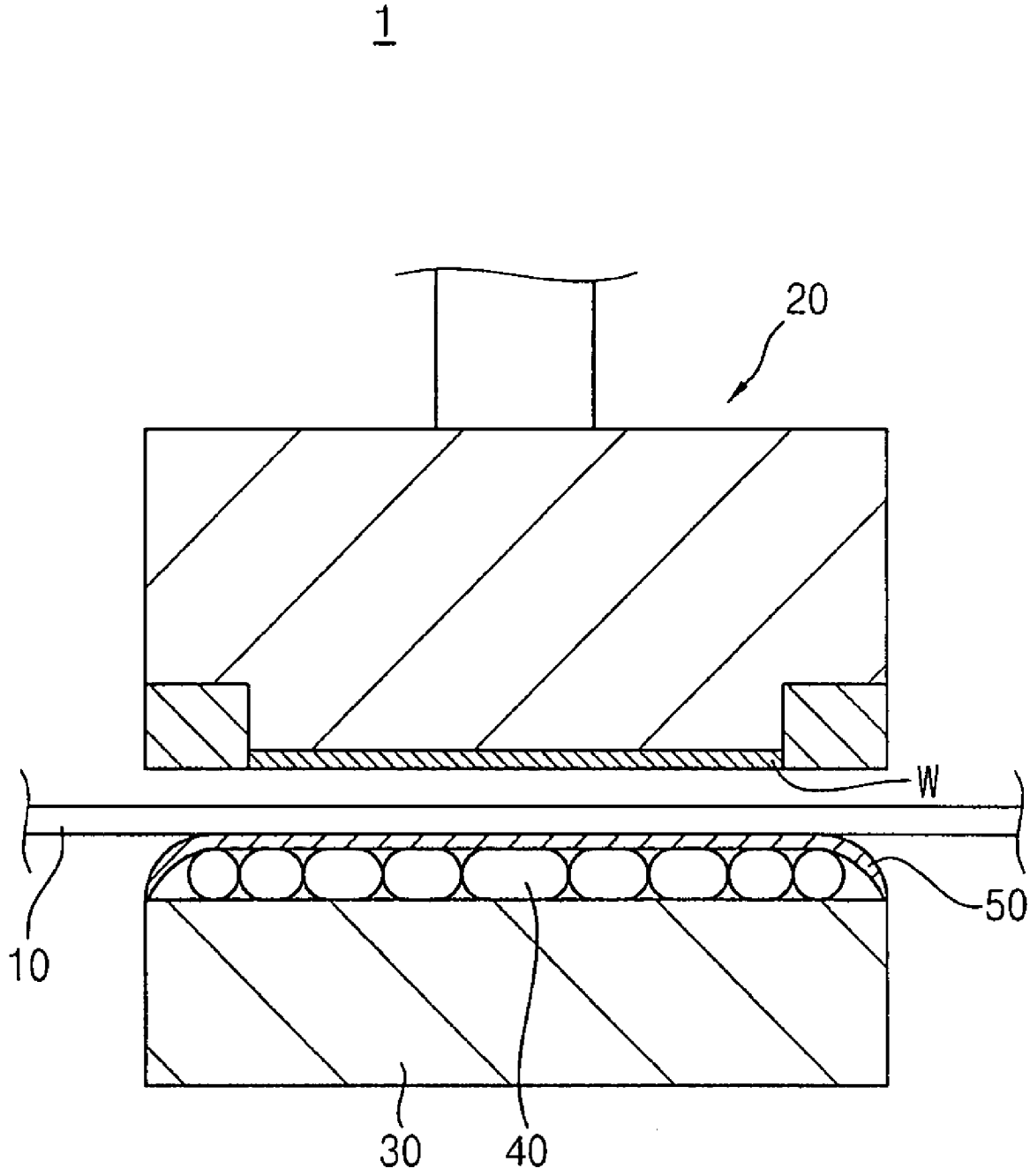
FIG. 1 is a view that schematically illustrates a structure of a conventional CMP apparatus.

Embodiments of the invention are described more fully hereinafter with reference to the accompanying drawings, in which example embodiments of the invention are shown. The present invention may, however, be embodied in many different forms and should not be construed as limited to the example embodiments set forth herein. Rather, these example embodiments are provided so that this disclosure will be thorough and complete. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the present invention are described herein with reference to cross-section illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example Embodiment 1 (Platen Assembly)

Figure 2:
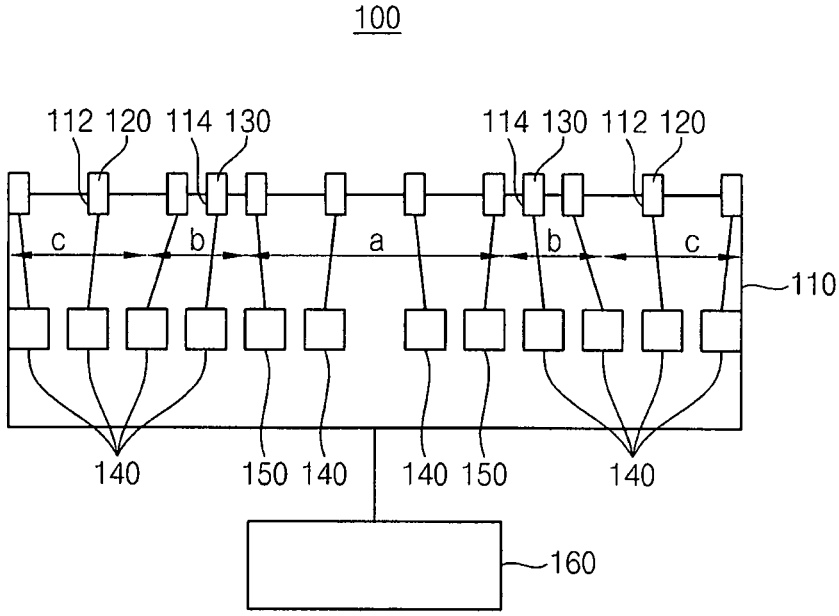
FIG. 2 is a view that illustrates a structure of a platen assembly in accordance with a first example embodiment of the present invention.
Figure 3:
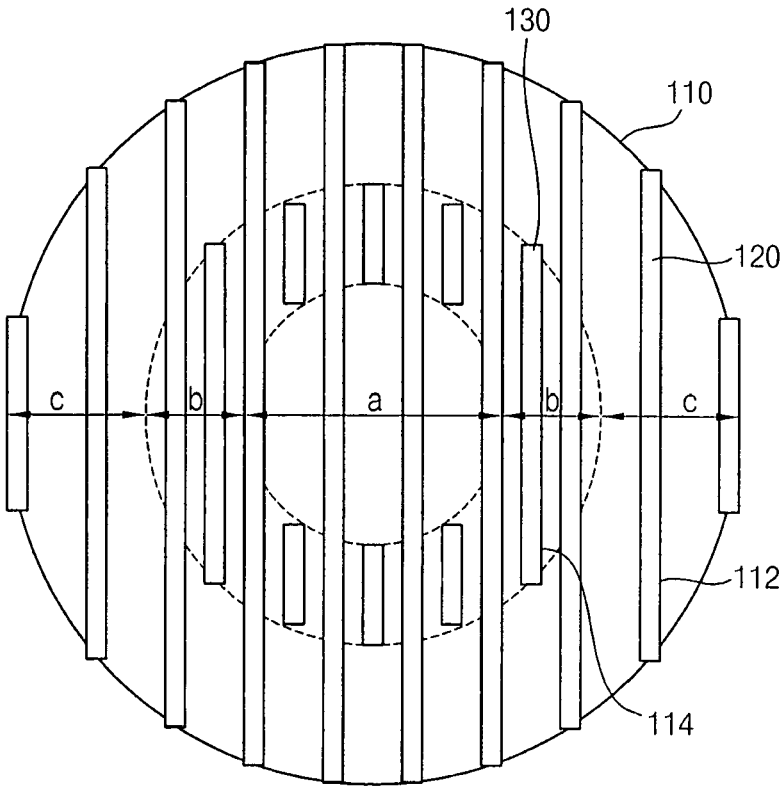
FIG. 3 is a plan view illustrating the platen assembly shown in FIG. 2.

FIG. 2 is a view illustrating a structure of a platen assembly in accordance with a first example embodiment of the present invention, and FIG. 3 is a plan view illustrating the platen assembly shown in FIG. 2.

Referring to FIGS. 2 and 3, the platen assembly 100 in accordance with the first example embodiment of the present invention includes a platen 110, first and second bladders 120 and 130, first and second pressure controllers 140 and 150, and an operation unit 160.

The platen 110 is in a disk shape and has a size that is sufficiently larger than that of a wafer. For example, the platen 110 may have a diameter that is twice that of the wafer.

The platen 110 supports a polishing belt against which the wafer is polished. A surface of the wafer on which a thin layer is formed, which is referred to as polished surface of the wafer hereinafter, makes contact with a surface of the polishing belt. The polishing belt sags in a opposite direction in proportion to a force exerted on the polishing belt by the wafer. The platen 110 supports the polishing belt, to thereby minimize the sagging of the polishing belt. Accordingly, the platen 110 retains the polishing belt in a horizontal orientation, so that the wafer is uniformly polished due to uniform contact with the polishing belt.

A plurality of first and second grooves 112 and 114 are formed on a surface of the platen 110. The first grooves 112 are distributed across an entire surface of the platen 110, and extend in a first direction. The first grooves 112 are spaced apart from one another by a uniform distance, so that the first grooves 112 are parallel to each other.

The second grooves 114 are positioned at a middle portion, i.e., within reference mark b of FIG. 2, of the surface of the platen 110 between a central portion, i.e., a reference mark a in FIG. 2, and a peripheral portion, i.e., a reference mark c in FIG. 2 of the surface of the platen 110. The second grooves 114 extend in the first direction, like the first grooves 112. Accordingly, the second grooves 114 are distributed between the first grooves 112 and are spaced apart from one another by a uniform distance, so that the second grooves 114 are parallel to each another.

A first bladder 120 is positioned along each of the first grooves 112, so that a plurality of the first bladders 120 extend in the first direction across an entire surface of the platen 110, and the first bladders 120 are spaced apart from one another by a uniform distance. As a result, the first bladders 120 neighboring each other are oriented parallel to each other. In an example embodiment, the first bladders 120 may be hollow, and may protrude from the surface of the platen 110. As a result, the first bladders 120 impart pressure on the polishing belt. In another example embodiment of the present invention, the first bladders 120 contain a gas or a liquid as a medium.

The second bladder 130 is positioned along each of the second grooves 114, so that a plurality of the second bladders 130 extend in the first direction at the middle portion b of the surface of the platen 110, and the second bladders 130 are spaced apart from one another by a uniform distance. As a result, the second bladders 130 neighboring each other are oriented parallel to each other. In an example embodiment, the second bladder 130 may be hollow, and may protrude from the surface of the platen 110. As a result, the second bladders 130 impart pressure on the polishing belt. In another example embodiment of the present invention, the second bladders 120 contain a gas or a liquid as a medium.

While only the first bladders 120 are present in the central and peripheral portions a and c of the surface of the platen 110, both of the first and second bladders 120 and 130 are positioned at the middle portion b of the surface of the platen 110. Accordingly, the first bladders 120 are spaced apart from one another by a first distance in the central and peripheral portions a and c of the surface of the platen 110, and the first and second bladders 120 and 130 are spaced apart from one another by a second distance less than the first distance in the middle portion b of the surface of the platen 110. As a result, the polishing belt may be pressurized at a first pressure at the central and peripheral portions a and c of the platen 110 by the first bladders 120, and may be pressurized at a second pressure greater than the first pressure at the middle portion b of the platen 110 by the combination of the first and second bladders 130.

Although the present example embodiment discloses that the first and second bladders 120 and 130 are positioned along the first and second grooves 112 and 114 on the surface of the platen 110, the first and second bladders 120 and 130 may also optionally be directly positioned on the surface of the surface of the platen 110 along the first direction in such a manner that the first and second bladders 120 and 130 are properly spaced apart from one another by uniform distances.

According to a conventional polishing apparatus, a force is exerted on a wafer and the wafer is applied to a polishing belt during the polishing process, and thus the pressure applied at the peripheral portion of the wafer is much greater than that applied at a central portion of the wafer. As a result, the conventional CMP apparatus is limited by the problem that the amount of material polished at the peripheral portion of the water is greater than of the amount polished at the central portion of the wafer.

In an example embodiment of the present invention, the central portion of the wafer makes contact with the polishing belt under pressure by the middle portion b of the platen 110, thereby addressing the above-mentioned limitations of the conventional polishing apparatus. That is, the polishing belt is pressurized in such a manner that the pressure at the middle portion b of the platen 110 is greater than the pressure at the central and peripheral portions a and c of the platen 110. Accordingly, an increased pressure is applied at the central portion of the wafer as compared to the peripheral portion of the wafer by the platen 110, so that the pressure distribution applied to the wafer can be compensated for by the pressure distribution of the polishing pad. As a result, a thin layer on the wafer can be uniformly polished during a polishing process.

The first pressure controller 140 is connected to the first bladders 120, and individually controls the pressure of each of the first bladders 120. In an example embodiment, all of the first bladders 120 may have the same pressure or each of the first bladders 120 may have individual pressure different from that of other first bladders 120. Accordingly, the pressure applied on the polishing belt may be controlled by the first bladders 120.

The second controller 150 is connected to the second bladders 130, and individually controls the pressure of each of the second bladders 130. In an example embodiment, all of the second bladders 130 may have the same pressure or the second bladders 130 may have individually different pressures with respect to each other. Accordingly, the pressure distribution applied to the polishing belt by the platen may be controlled by the second bladders 130. The pressure applied to the polishing belt can be accurately varied in accordance with portions of the platen 110 by controlling the pressure of the first and second bladders 120 and 130, so that the degree of polishing of the wafer can be uniform across an entire surface of the wafer.

In an example embodiment, the first and second bladders 120 and 130 are spaced apart from one another, so that the pressure applied to each of the individual first and second bladders 120 and 130 by the first and second pressure controllers 140 and 150 has no effect on neighboring bladders, a limitation associated with the conventional approach. Therefore, the pressure applied to the wafer can be accurately controlled by controlling the pressure of the first and second bladders 120 and 130.

The operation unit 160 rotates the platen 110, and the first and second bladders 120 and 130 are rotated in accordance with the rotation of the platen 110. The contact position of the polishing belt with the first and second bladders 120 and 130 varies due to the rotation of the first and second bladders 120 and 130. That is, the elongated, bar-shaped, first and second bladders 120 and 130 rotate with respect to the polishing belt, and thus the polishing belt is pressurized at various portions thereof by the rotating bladders 120 and 130. Accordingly, the amount of polishing of the wafer by the polishing belt can be uniform.

Example Embodiment 2 (Platen Assembly)

Figure 4:
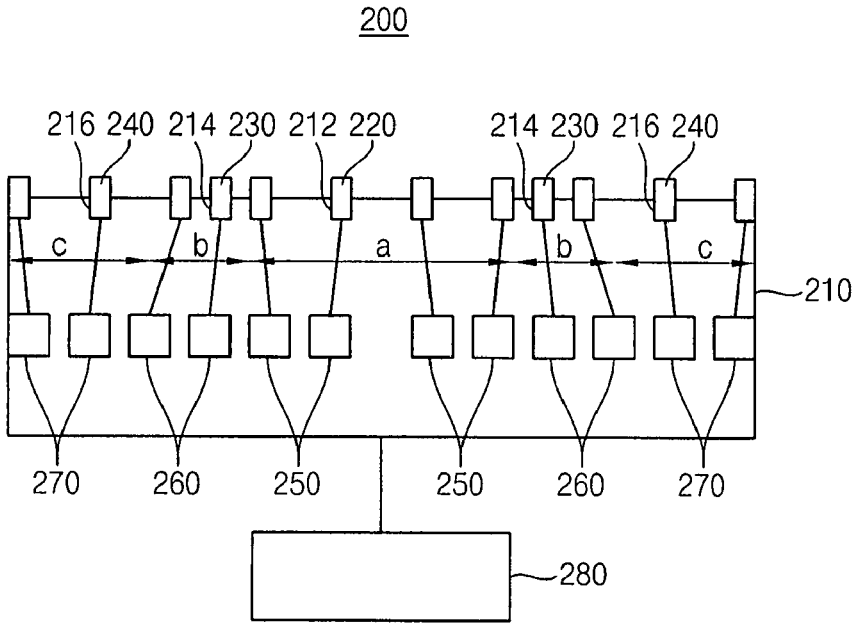
FIG. 4 is a view illustrating a structure of a platen assembly in accordance with a second example embodiment of the present invention.
Figure 5:
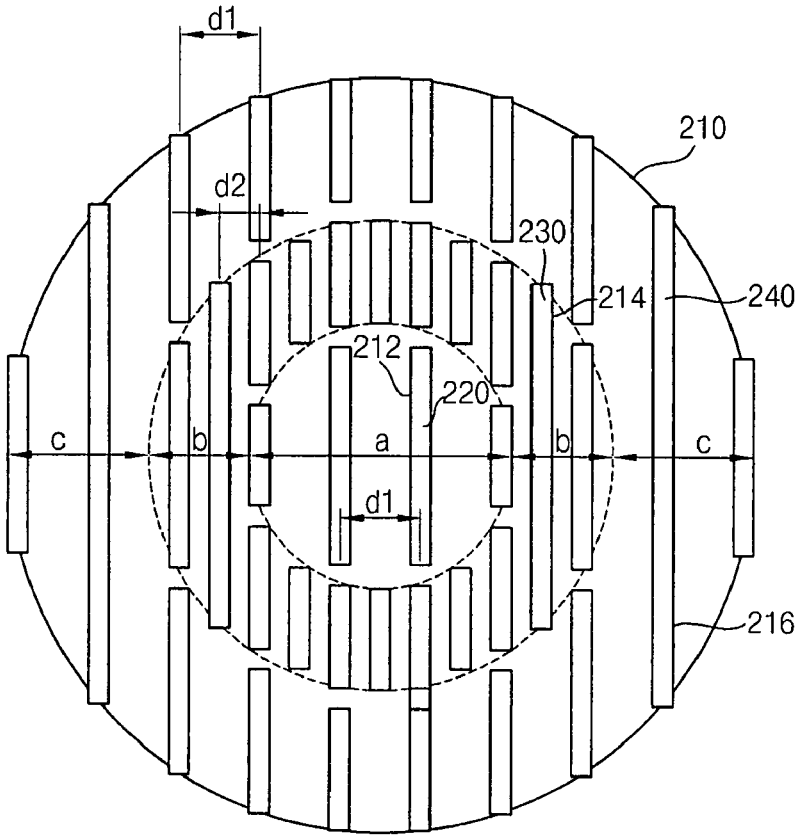
FIG. 5 is a plan view illustrating the platen assembly shown in FIG. 4.

FIG. 4 is a view illustrating a structure of a platen assembly in accordance with a second example embodiment of the present invention, and FIG. 5 is a plan view illustrating the platen assembly shown in FIG. 4.

Referring to FIGS. 4 and 5, the platen assembly 200 in accordance with the second example embodiment of the present invention includes a platen 210, first, second and third bladders 220, 230 and 240, first, second and third pressure controllers 240, 250 and 260, and an operation unit 280. In the present embodiment, the platen assembly 200 has a structure that is similar to of the platen assembly 100 in the first example embodiment above, except for the dimensions and shapes of the grooves on the platen 210 and the bladders 220, 230, 240.

The platen 210 is in a disk shape and includes the first, second and third grooves 212, 214 and 216 on a surface thereof.

The first and third grooves 212 and 216 are distributed on a central portion a and a peripheral portion c of a surface of the platen 210, respectively. The first and third grooves 212 and 216 extend in a first direction, and are spaced apart from each other by a first distance d1. The first and third grooves 212 and 216 are parallel to each other.

The second grooves 214 are positioned at a middle portion b of the surface of the platen 210 between the central portion a and the peripheral portion c of the surface of the platen 210. The second grooves 214 also extend in a direction substantially the same as the first direction, which the first and third grooves 212 and 216 extend, and are spaced apart from one another by a second distance d2 that is less than the first distance d1. The second grooves 214 are also parallel with one another.

The first bladder 220 is positioned along each of the first grooves 212, and the third bladder 240 is positioned along each of the third grooves 216. A plurality of the first bladders 220 extend in the first direction on the central portion a of the surface of the platen 210, and the first bladders 220 are spaced apart from one another by a first distance d1. A plurality of the third bladders 240 extends in the first direction on the peripheral portion c of the surface of the platen 210, and each of the third bladders 240 is spaced apart from one another by a first distance d1. The first and third bladders 220 and 240 are aligned parallel to each other. In an example embodiment, the first and the third bladders 220 and 240 may be hollow, and may protrude from the surface of the platen 210. As a result, the first and third bladders 220 and 240 impart pressure on the polishing belt. In another example embodiment of the present invention, the first and third bladders 220 and 240 contain a gas or a liquid as a medium.

The second bladder 230 is positioned along each of the second grooves 114, so that a plurality of the second bladders 130 extend in the first direction at the middle portion b of the surface of the platen 110, and the second bladders 130 are spaced apart from one another by a second distance d2. As a result, the second bladders 230 neighboring each other are also oriented parallel with each other. In an example embodiment, the second bladders 230 may be shaped into a hollow bar, and may protrude from the surface of the platen 210. As a result, the second bladders 230 impart pressure on the polishing belt. In another example embodiment of the present invention, the second bladders 230 contain a gas or a liquid as a medium.

As a result, the polishing belt may be pressurized at a first pressure at the central and peripheral portions a and c of the platen 210 by the more widely distributed first and third bladders 220 and 240, and may be pressurized at a second pressure greater than the first pressure at the middle portion b of the platen 210 by the more closely distributed second bladders 230.

Although the present example embodiment discloses that the first, second and third bladders 220, 230 and 240 are positioned along the first, second and third grooves 212, 214 and 216 on the surface of the platen 210, the first, second and third bladders 220, 230 and 240 may also optionally be positioned directly on the surface of the platen 210 along the first direction.

According to a conventional polishing apparatus, a force is exerted on a wafer, and the wafer is applied to a polishing belt during the polishing process, and thus the pressure applied at the peripheral portion of the wafer is much greater than that applied at a central portion of the wafer. As a result, the conventional CMP apparatus is limited by the problem that the amount of material polished at the peripheral portion is greater than the amount polished at the central portion of the wafer.

In an example embodiment of the present invention, the central portion of the wafer makes contact with the polishing belt under pressure by the middle portion b of the platen 210, thereby addressing the above-mentioned limitations of the conventional polishing apparatus. That is, the polishing belt is pressurized by the platen 210 in such a manner that a first portion corresponding to the middle portion b of the platen 210 is pressurized to a larger degree than a second portion corresponding to the central and peripheral portions a and c of the platen 210. Accordingly, an increased pressure is applied at the central portion of the wafer as compared to the peripheral portion of the wafer by the platen 210, so that the pressure distribution applied to the wafer can be compensated for by the pressure distribution of the polishing pad, to thereby become equilibrium state. As a result, a thin layer on the wafer can be uniformly polished during a polishing process.

According to the present example embodiment, the platen assembly 200 may pressurize various portions of the polishing belt at different pressures, to ensure that a thin layer on the wafer can be uniformly polished during the polishing process.

Apparatus for Polishing a Wafer

Figure 6:
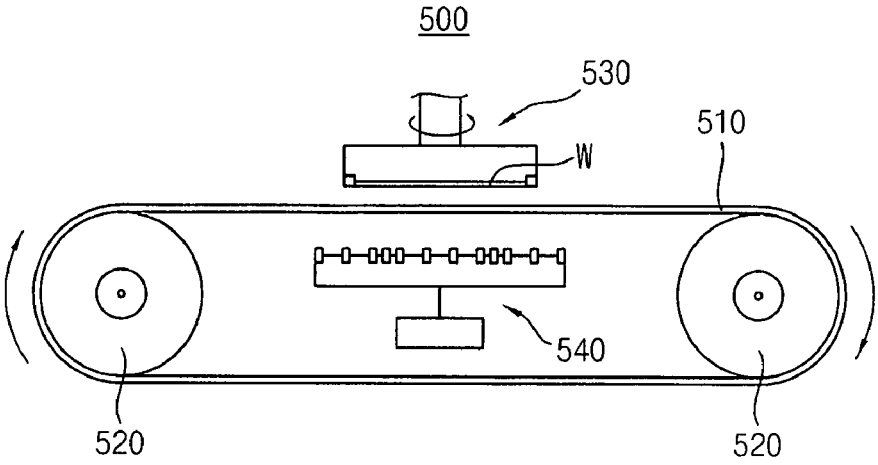
FIG. 6 is a view illustrating an apparatus for polishing a wafer according to an example embodiment of the present invention.

FIG. 6 is a view illustrating an apparatus for polishing a wafer according to an example embodiment of the present invention.

Referring to a FIG. 6, the apparatus 500 for polishing a wafer (hereinafter, referred to as "polishing apparatus") includes a polishing belt 510, a roller 520, a polishing head 530, a platen assembly 540 and a slurry provider (not shown).

The polishing belt 510 makes contact with a wafer W and applies a frictional force to the wafer W. In an example embodiment, the polishing belt 510 has a shape of continuous ring, and has a sufficient width to interface with the entire wafer W. For example, the width of the polishing belt 510 can be twice as large as a diameter of the wafer W.

The pair of rollers 520 are installed to the polishing apparatus 500 and each of the rollers 520 has a cylindrical shape. Each roller 520 revolves on its own axis in the same direction, and the polishing pad 510 circulates in the same direction in accordance with the revolution of the rollers 520.

The polishing head 530 secures the wafer W in such a manner that a polished surface of the wafer W faces an upper surface of the polishing belt 510. Further, the polishing head 530 maintains contact between the polished surface of the wafer W to be polished and the upper surface of the polishing belt 510 during the polishing process. In an example embodiment, the polishing head 530 absorbs a rear surface of the wafer W using a vacuum, and moves upwardly and downwardly relative to the polishing belt 510. The rear surface of wafer W is opposite the polished surface of the wafer W. The polishing head 530 rotates on its own axis, so that the wafer W secured to the polishing head 530 is also rotated in accordance with the rotation of the polishing head 530. Accordingly, amount of material polished is substantially uniform over the polished surface of the wafer W.

The slurry provider is installed over the polishing belt 510, and slurry for a polishing process is provided onto the upper surface of the polishing belt 510. The slurry moves on the belt to the region of contact between the wafer W and the polishing belt in accordance with the circulation of the polishing belt 510. The slurry chemically reacts with the polished surface of the wafer W, so that a thin layer on the polished surface of the wafer W is chemically and mechanically removed.

The platen assembly 540 supports a lower surface of the polishing belt 510, and pressurizes different portions of the polishing belt 510 at respectively different pressures. The platen assembly 540 has the same structure as the first and second example embodiments of the platen assembly described above with reference to FIGS. 2 to 5; thus further detailed description of the platen assembly 540 is omitted in the present discussion of the polishing apparatus.

Figure 7:
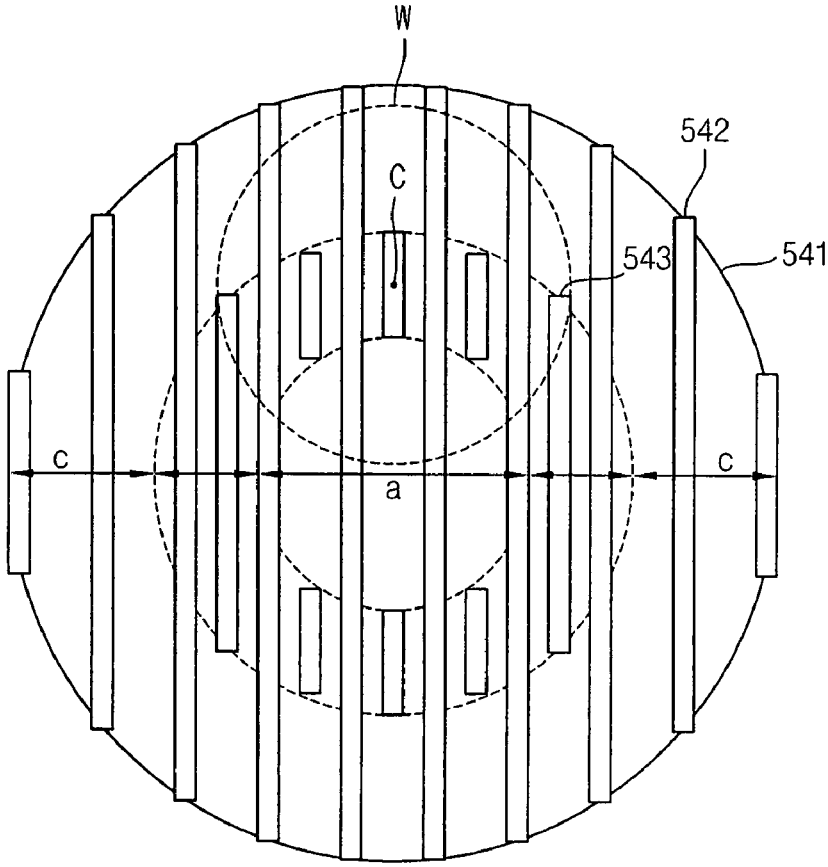
FIG. 7 is a view illustrating the relative positions of the wafer and the platen assembly in the polishing apparatus shown in FIG. 6.

FIG. 7 is view illustrating relative positions of the wafer and the platen assembly of the polishing apparatus shown in FIG. 6.

Referring to FIG. 7, a center C of the wafer W is positioned at a first portion of the upper surface of the polishing belt 510 corresponding to the middle portion of a platen of the platen assembly 540. In an example embodiment, the middle portion b of the platen may apply a first pressure to the polishing belt 510 and a central portion a and a peripheral portion c of the platen may apply a second pressure, the second pressure being substantially less than the first pressure, to the polishing belt 510. Accordingly, the central portion of the wafer W may be pressurized to a substantially higher degree more than the peripheral portion of the wafer W by the platen of the platen assembly 540.

The polishing head 530 pushes the wafer W toward the polishing belt 510, and thus the wafer W makes contact with the polishing belt 510 while polishing the wafer W. When the wafer W is pushed by the polishing head 530, greater compression force is applied to the peripheral portion of the wafer W than the central portion of the wafer W due to the configuration of the polishing head 530.

Accordingly, the compression force exerted on the wafer W by the polishing head 530 can be compensated for, or canceled by, by the pressure profile applied to the polishing belt 520 by the platen of the platen assembly 540, so that the amount of material that is polished can be substantially uniform on the wafer W during the polishing process.

Method of Polishing a Wafer

Figure 8:
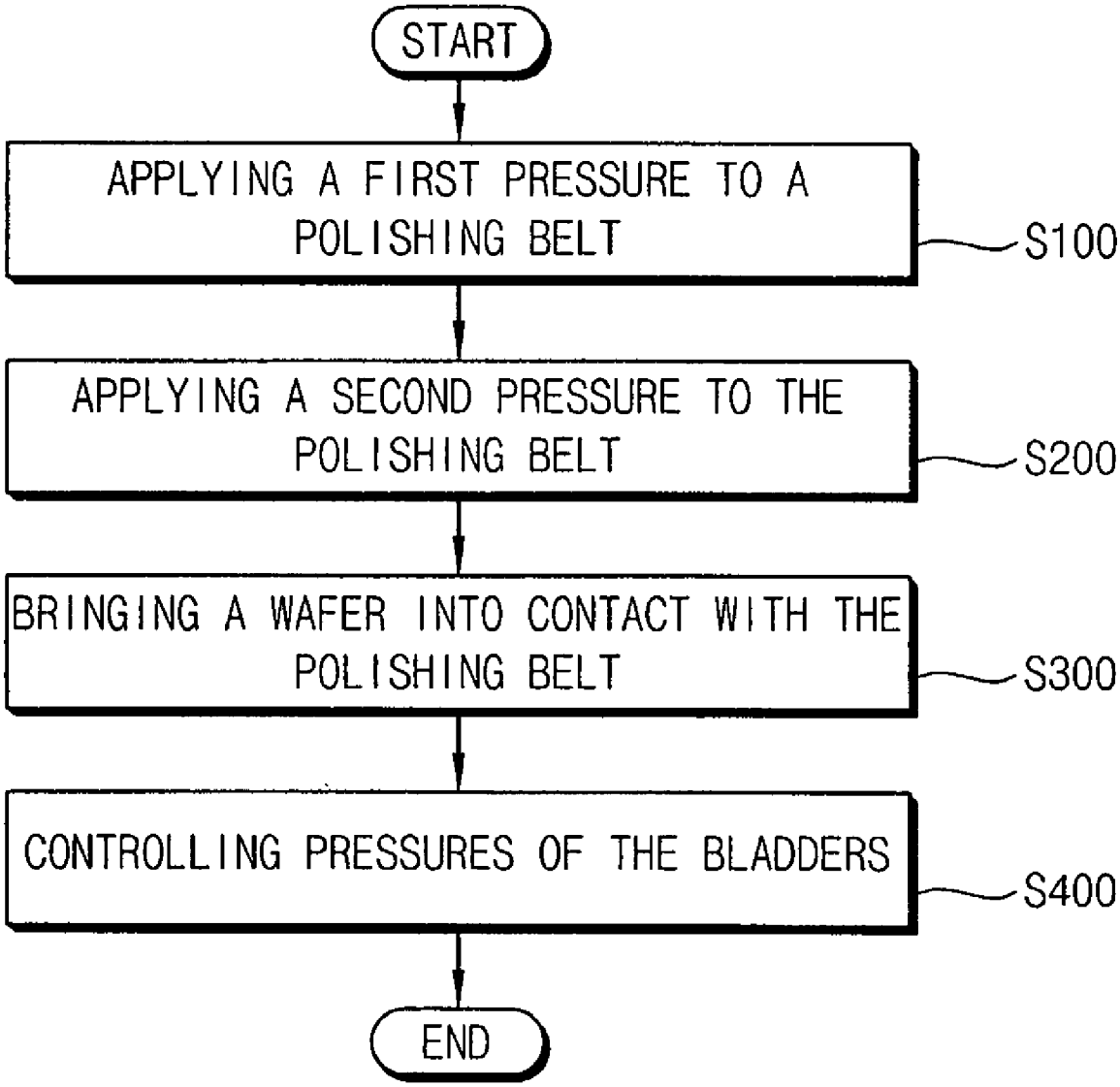
FIG. 8 is a flow chart illustrating a method of polishing a wafer according to an example embodiment of the present invention.

FIG. 8 is a flow chart illustrating a method of polishing a wafer according to an example embodiment of the present invention.

Referring to FIGS. 6 and 8, the polishing belt 510 circulates in accordance with the rotation of the roller 520. The lower surface of the polishing belt 510 is supported by the platen of the platen assembly 540. The first bladders of the platen assembly 540 pressurize a first portion of the lower surface of the polishing belt 510 to a first pressure (step S100). In an example embodiment of the present invention, the first bladders are positioned at the central portion a and the peripheral portion c of the platen and extend in the first direction. The first bladders are spaced apart from one another by a first distance d1.

The second bladders of the platen assembly 540 are positioned at the middle portion b of the platen between the central portion a and the peripheral portion c of the platen and also extend in the first direction. The second bladders are spaced apart from one other by a second distance d2 that is less than the first distance d1. The second bladders of the platen assembly 540 pressurize a second portion of the lower surface of the polishing belt 510 to a second pressure (step S200). In an example embodiment of the present invention, the second pressure is greater than the first pressure.

When the lower surface of the polishing belt 510 is pressurized by the platen assembly 540, the polishing head 510 moves in a downward direction, and thus the wafer W is pushed onto the polishing belt. As a result, the polishing head 510 brings the surface of the wafer W to be polished into contact with the upper surface of the polishing belt (step S300).

When the surface of the wafer W to be polished makes contact with the upper surface of the polishing belt 510, the center C of the wafer W is positioned at a portion of the upper surface of the polishing belt 510 corresponding to the middle portion b of the platen of the platen assembly 540, so that the central portion of the wafer W is pressurized to a substantially greater extent than the peripheral portion of the wafer W.

However, when the wafer W is pushed toward the polishing belt 510 by the polishing head 530, the compression force provided by the polishing head 530 is substantially higher in the peripheral portion of the wafer W relative to the central portion of the wafer W. As a result, the force profile of the compression force of the polishing head 530 is compensated for, or cancelled by, the pressure profile applied by the platen assembly 540, so that the pressure is uniformly applied to the entire wafer W surface. Therefore, the degree of polishing of, or the amount of material removed from, the polished surface of the wafer W, by the polishing process Is substantially uniform.

The respective pressures of the first and second bladders of the platen assembly 540 are controlled by the first and second pressure controllers, respectively (step S400). Control of the first and second bladders of the platen assembly 540 in this manner improves the uniformity of the pressure applied on the wafer W to thereby improve the polishing uniformity on the wafer W.

According to the present invention, a plurality of bar-shaped bladders apply pressure to different portions of the polishing belt, respectively, and thus, the pressure exerted at different locations of the polishing belt are different from one another. In addition, each of the bladders is individually controlled by the pressure controller. Therefore, the pressure applied to the polishing belt can be accurately controlled and the degree of polishing of the wafer in the polishing process is substantially uniform.

The foregoing is illustrative of the embodiments of the present invention and is not to be construed as limiting thereof. Although various example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims.

What is claimed is:

1. A platen assembly for a polishing apparatus, comprising:

a platen supporting a polishing belt that makes contact with an object during a polishing process, the platen providing a pressure on the polishing belt during the polishing process;

a plurality of first bladders extending in a first linear direction on an entire surface of the platen, and spaced apart by a uniform distance, the first bladders applying pressure to the polishing belt; and a plurality of second bladders extending in the first linear direction on an annular middle portion of the surface of the platen from a first side of the middle portion to a second side of the middle portion opposite the first side, the middle portion between a circular central portion and an annular peripheral portion of the platen, and each second bladder positioned between first bladders of the plurality of first bladders that are on the middle portion of the surface of the platen, the second bladders likewise applying pressure to the polishing belt.

2. The platen assembly of claim 1, wherein the first bladders include central bladders positioned on the central portion of the platen, middle bladders positioned on the middle portion of the platen and peripheral bladders positioned on the peripheral portion of the platen.

3. The platen assembly of claim 1, wherein the first bladders are spaced apart from one another on the central and peripheral portions of the platen by a first distance and apply a first pressure to the polishing belt, and wherein the first and second bladders are spaced apart from one another on the middle portion of the platen by a second distance less than the first distance and apply a second pressure greater than the first pressure to the polishing belt.

4. The platen assembly of claim 1, further comprising a first pressure controller for controlling first pressures of the first bladders, and a second pressure controller for controlling second pressures of the second bladders.

5. The platen assembly of claim 1, further comprising an operation unit for rotating the platen.

6. An apparatus for polishing an object, comprising:

a polishing belt in contact with the object;

a roller for circulating the polishing belt;

a polishing head to which the object is secured in such a structure that a surface of the object to be polished faces an upper surface of the polishing belt, the polishing head bringing the surface of the object to be polished into contact with the upper surface of the polishing belt when the polishing belt is circulated; and a platen assembly including a platen supporting the polishing belt to provide a pressure on the polishing belt when the polishing belt is circulated, a plurality of first bladders extending in a first linear direction on an entire surface of the platen and spaced apart by a uniform distance, and a plurality of second bladders extending in the first linear direction on an annular middle portion of the surface of the platen from a first side of the middle portion to a second side of the middle portion opposite the first side, the middle portion between a circular central portion and an annular peripheral portion of the platen, and each second bladder positioned between first bladders of the plurality of first bladders that are on the middle portion of the surface of the platen, the first and second bladders likewise applying pressure to the polishing belt.

7. The apparatus of claim 6, wherein a center of the surface of the object to be polished is positioned on the upper surface of the polishing belt corresponding to the middle portion of the platen when the polishing belt is circulated.

8. The apparatus of claim 6, wherein the first bladders include central bladders positioned on the central portion of the platen, middle bladders positioned on the middle portion of the platen and peripheral bladders positioned on the peripheral portion of the platen.

9. The apparatus of claim 6, wherein the first bladders are spaced apart from one another on the central and peripheral portions of the platen by a first distance and apply a first pressure to the polishing belt, and wherein the second bladders are spaced apart from one another on the middle portion of the platen by a second distance less than the first distance and apply a second pressure greater than the first pressure to the polishing belt.

10. The apparatus of claim 6, wherein the platen assembly further includes a first pressure controller for controlling first pressures of the first bladders, and a second pressure controller for controlling second pressures of the second bladders.

11. The apparatus of claim 6, wherein the platen assembly further includes an operation unit for rotating the platen.

12. A method of polishing an object, comprising:

applying a first pressure to a lower surface of a circulating polishing belt by a plurality of first bladders extending in a first linear direction on a circular central portion and an annular peripheral portion of an upper surface of a platen and spaced apart from one another by a first distance;

applying a second pressure to the lower surface of a circulating polishing belt by a plurality of second bladders extending in the first linear direction on an annular middle portion of the upper surface of the platen from a first side of the middle portion to a second side of the middle portion opposite the first side, the middle portion between the central portion and the peripheral portion of the upper surface of the platen and spaced apart from one another by a second distance less than the first distance, wherein each second bladder applying the second pressure is positioned between first bladders of the plurality of first bladders applying the first pressure that are on the middle portion of the surface of the platen; and bringing a surface of the object to be polished into contact with an upper surface of the polishing belt.

13. The method of claim 12, wherein a center of the surface of the object to be polished makes contact with a portion of the upper surface of the polishing belt corresponding to the middle portion of the platen when the polishing belt is circulated.

14. The method of claim 12, further comprising controlling pressures of the first and second bladders in accordance with a degree of polishing of different regions of the object.

15. The platen assembly of claim 1, wherein the platen assembly is constructed and arranged such that the first linear direction of the first and second bladders is transverse to a direction of the polishing belt during the polishing process.

16. The apparatus of claim 6, wherein the apparatus is constructed and arranged such that the first linear direction of the first and second bladders is transverse to a direction of the polishing belt during a polishing process.

17. The method of claim 12, wherein the platen assembly is constructed and arranged such that the first linear direction of the first and second bladders is transverse to a direction of the polishing belt.

* * * * *